United States Patent [19]

Sohre

[11] 3,982,378

[45] Sept. 28, 1976

[54] ENERGY CONVERSION DEVICE

[76] Inventor: Joachim S. Sohre, 1 Lakeview Circle, Ware, Mass. 01082

[22] Filed: Mar. 13, 1975

[21] Appl. No.; 557,953

[52] U.S. Cl. ..... 60/650; 60/682; 60/721; 62/5

[51] Int. Cl.[2] ..... F25B 9/02

[58] Field of Search ..... 62/5; 60/670, 671, 650, 60/651, 682, 721

[56] References Cited

UNITED STATES PATENTS

| | | | |
|---|---|---|---|
| 2,920,457 | 1/1960 | Bartlett, Jr. | 62/5 |
| 3,287,924 | 11/1966 | Bright | 62/5 |
| 3,788,064 | 1/1974 | Hawkins | 60/671 |

*Primary Examiner*—Allen M. Ostrager
*Attorney, Agent, or Firm*—Charles A. Warren

[57] ABSTRACT

A vortex tube construction in which the cold and hot fluids are recirculated to the inlet and energy is extracted from or added to the fluids either by heat exchange or by mechanical removal. This concept is adapted for other devices in which a flow of substantially homogeneous fluid is divided into separate flows at different energy levels.

27 Claims, 13 Drawing Figures

FIG. 9
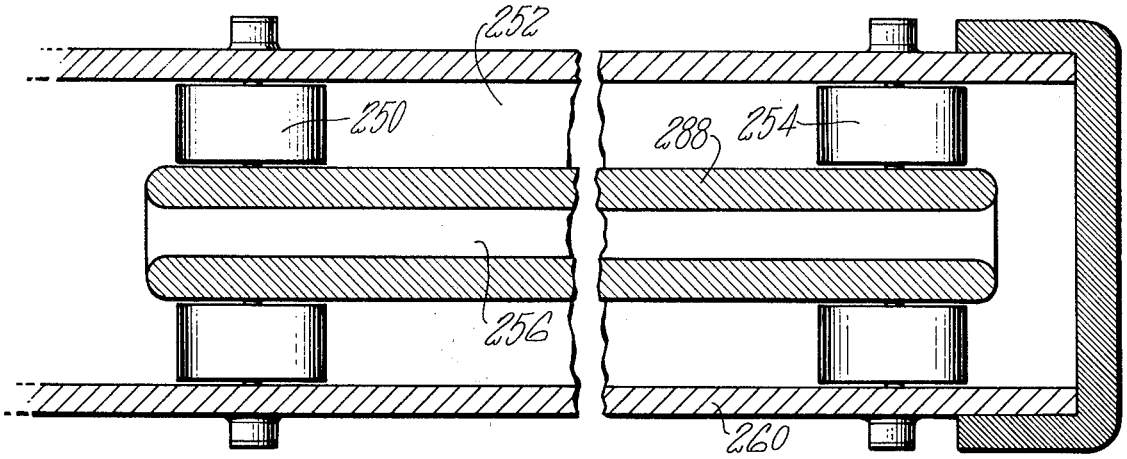
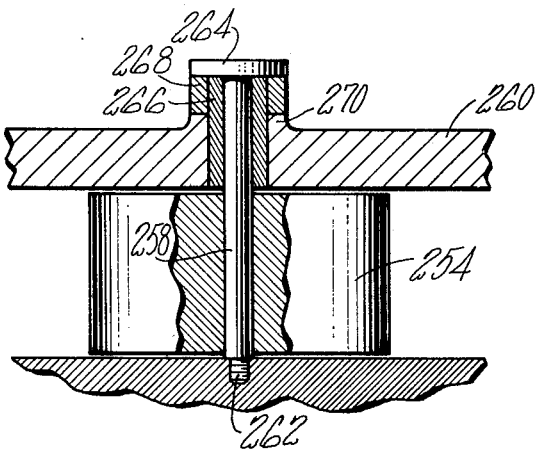
FIG. 10
FIG. 11
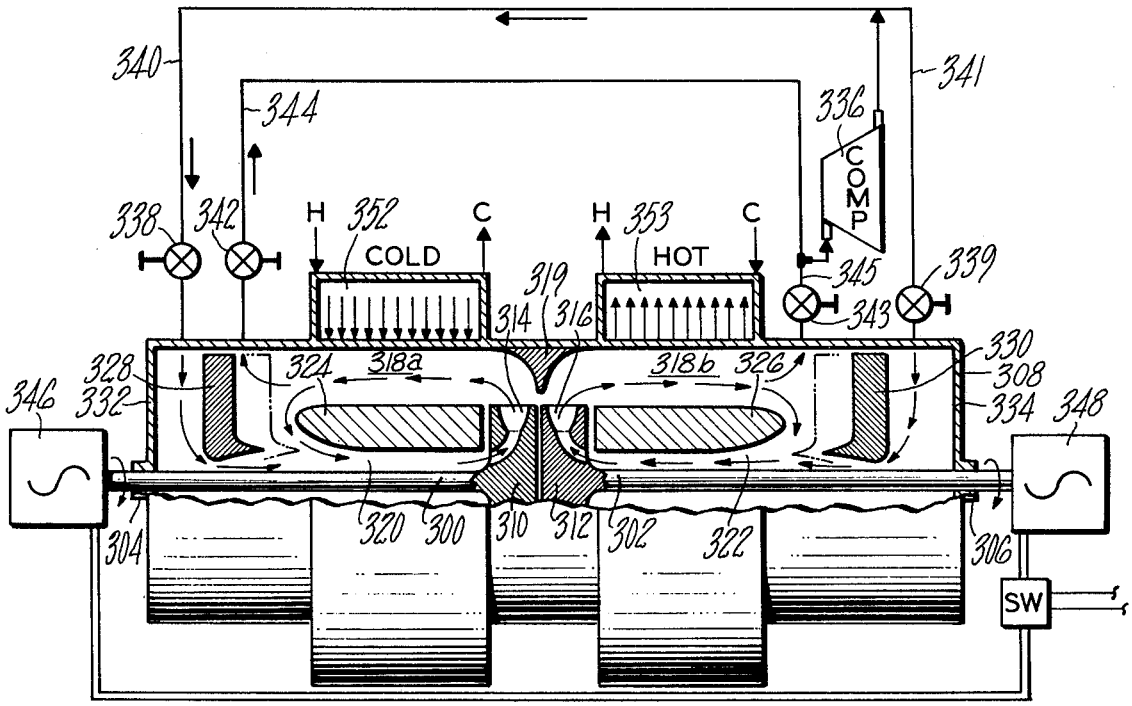

ENERGY CONVERSION DEVICE

STATEMENT OF THE INVENTION

Apparatus for the redistribution of energy within an initially homogeneous fluid, as in the Ranque-Hilsch vortex tube U.S. Pat. No. 1,952,281 or in Foa U.S. Pat. No. 3,361,336 has been used in heating or refrigeration by the direct use of the high energy fluid, for heating, or the low energy fluid for refrigeration and any kinetic energy is dissipated without being utilized. The present invention involves the recirculation of the fluid or fluids so as to recover the kinetic energy in the vortex and to return it to the vortex inlet with a minimum of loss. The invention contemplates the removal of heat from the high energy level fluid and/or the addition of energy to the low energy level fluid during this recycling for performing cooling or heating functions. The energy in the fluids may also be utilized in power generation if such use is desired, the entire unit being a self contained power unit.

The arrangement may be such that a transfer of energy from the cold to the hot side may occur for the purpose of additional cooling at one side or additional heating at the other side or for the purpose of extracting heat from a low level heat source such as the atmosphere, the ocean or solar energy for the purpose of high temperature generation on the hot side. The device contemplates a significantly high temperature of heat output on the hot side.

Other features and advantages of the invention will be apparent from the specification and claims and from the accompanying drawings which illustrate embodiments of the invention.

BRIEF DESCRIPTION OF THE DRAWING

FIG. 9 is a sectional view along line 9—9 of FIG. 8;

FIG. 10 is a sectional view of a detail;

FIG. 11 is a modified form of the device;

DESCRIPTION OF THE PREFERRED EMBODIMENT

Figure 1:
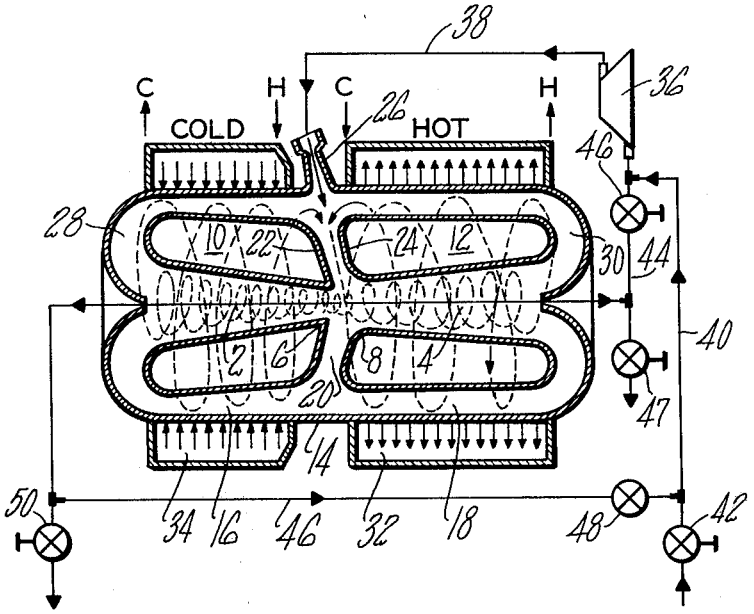
FIG. 1 is a schematic view of a simplified internal recirculating system.

Referring first to FIG. 1, the system is shown as an internal recirculating system in which the return system surrounds and is in concentric relation to the vortex tube. The tube is made up of coaxial passages 2 and 4, the former being the cold tube and is smaller at the inlet end 6 than the hot tube 8. The latter extends to the right, FIG. 1, and may be divergent in the direction of flow. These tubes are defined by the inner walls of cooperating annular bodies 10 and 12 located within and spaced from a casing 14 having an inner surface that defines, with the outer surfaces of the bodies 10 and 12, annular cold and hot passages 16 and 18 for the return of the cold and hot fluids to the vortex inlet 20.

This inlet 20 is established by an axial spacing of the two annular bodies so as to define the inlet passage therebetween. The adjacent end walls 22 and 24 of the bodies 10 and 12 may be parallel to one another, as shown, and the walls may make a slight angle to a radial plane so that the inflow through the passage 20 has a longitudinal component in an axial direction toward the hot tube.

The vortex for the tube is created by a nozzle 26 that is arranged tangentially to the periphery of the hot tube 8 to create a vortex at the inlet to this tube. The effect of this vortex is known. A hot fluid flow moves to the right in the hot tube with a significant swirl, and cold air flows to the left in the cold tube also with a significant swirl. The nozzle 26 may be of the type shown in the U.S. Pat. No. 3,804,335 to Sohre for efficient operation of the device.

At the discharge ends of the vortex tubes the hot and cold fluids are directed through curved passages 28 and 30 at the cold and hot ends respectively, these passages being defined between the toroidal ends of the casing 14 and the remote ends of the annular bodies 10 and 12. With proper configuration the hot and cold ends may have a temperature difference of as much as 180°F with an inlet pressure of 100 p.s.i. The temperature difference may reach several hundred degrees or even into the thousands depending upon the mode of operation and the materials for containment of the fluids. Removal of some of the heat energy in the hot fluid is accomplished by surrounding the casing 14 with a heat exchange chamber 32 substantially coextensive axially with the hot annular body 12. With conventional heat exchange devices such as tubes or fins on the casing 14 at this point much of the heat energy in the hot fluid may be removed and utilized. Similarly with a heat exchange chamber 34 externally of the casing 14 in the cold area coextensive with the cold annular body 10, a warm fluid flowing through the chamber 34 may be cooled as for refrigeration use and at the same time the low energy level in the cool portion is raised since the cold fluid in the vortex system is heated and thus the reclaimed heat is added to the combined fluids reentering the vortex chamber.

As the device operates, the hot and cold fluids in the recirculating passages may thus be respectively cooled and heated approximately to the same temperature and are re-energized by the effect of the nozzle fluid and drawn through passage 20 and into the vortex again. The kinetic energy in the fluids is not lost since the swirl of the fluids is not lost in their return through the recirculating passages and only a small input of energy through the nozzle or impeller is necessary to maintain continuing and effective operation.

For the energy make-up through the nozzle a compressor 36 may pressurize the fluid delivered through a conduit 38 to the nozzle. This fluid may be drawn from the atmosphere if the device is operating on air through an inlet conduit 40 controlled by a valve 42 or from the end of the hot tube through a conduit 44 controlled by valve 46. An outlet valve 47 permits exhaust of fluid from the conduit 44. Alternatively or in addition, fluid from the cold end may be supplied to the compressor through a conduit 46 with a control valve 48 therein. A valve 50 permits fluid in conduit 46 to exhaust if desired.

Figure 2:
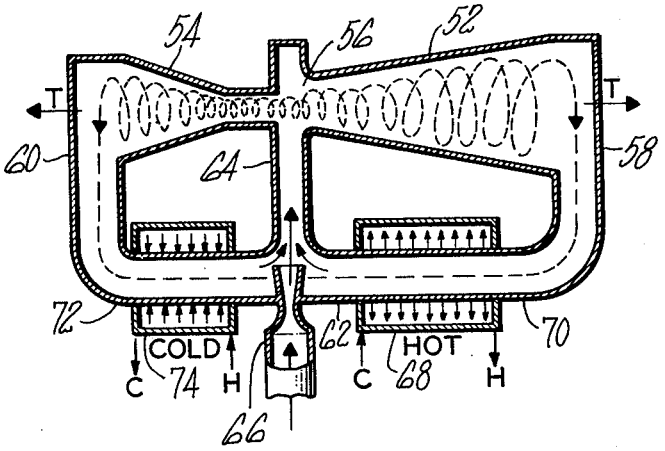
FIG. 2 is a schematic view of a simplified external recirculating system.

As an alternate to the internal recirculation of FIG. 1 the vortex tube of FIG. 2 may have an external recirculation. As shown, the hot tube 52 and cold tube 54 are coaxial as in FIG. 1 and are interconnected at their adjacent ends by the vortex section 56. At their outer ends, the tubes are connected by connecting tubes 58 and 60 to a return duct 62. This is preferably a tangential connection to minimize loss of kinetic energy. At a point adjacent the vortex section 56 is a recycling tube 64 by which the fluid in the duct 62 is returned to the vortex section. A make-up nozzle 66 delivers fluid at high velocity into the tube 64 for maintaining the necessary vortex in the vortex section 56. Energy is removed from the system by a heat exchanger 68 surrounding the hot portion 70 of the return duct which may be used to heat a fluid circulating in the heat exchanger the hot fluid then being utilized for heating or other purposes.

Similarly the cold portion 72 of the return duct has a surrounding heat exchanger 72 that may be used for cooling a fluid in the heat exchanger, the cooled fluid then being used for refrigeration or other purposes where a cooling action is needed. In this way, heat energy is returned to the system at the same time providing for cooling.

Figure 3:
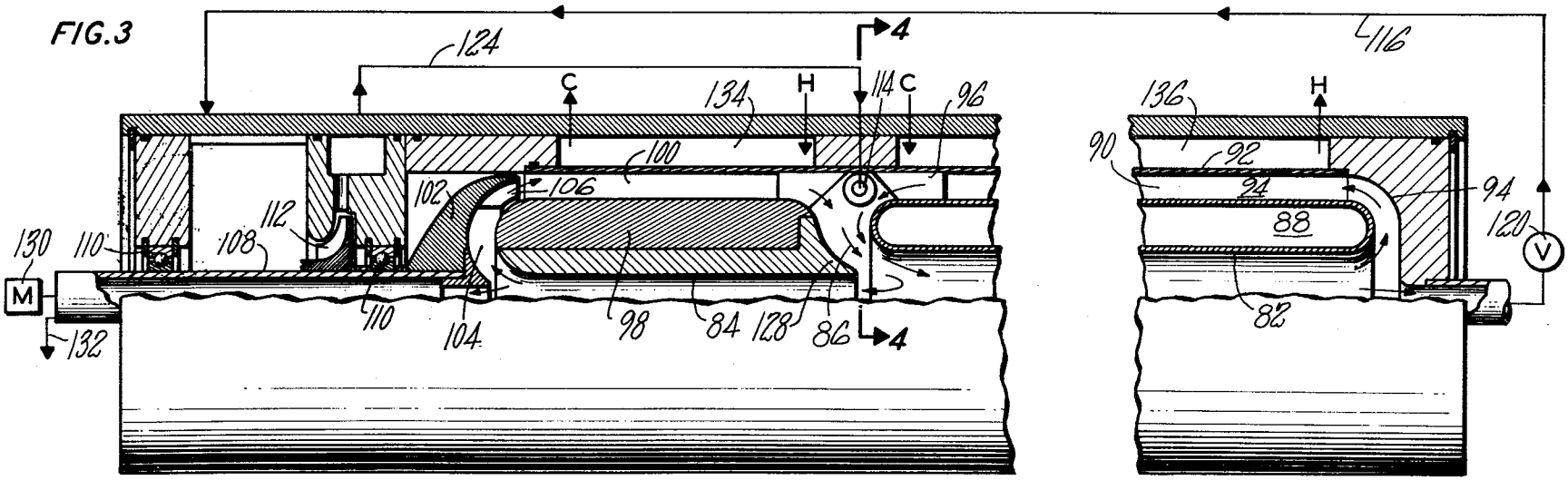
FIG. 3 is a longitudinal sectional view through a recirculating vortex tube.

Other arrangements for removal of energy from the system may be utilized. For example, as shown in FIG. 3, the vortex tube 80 consists of two ducts, the hot duct 82 and the cold duct 84 extending coaxially in opposite directions from the vortex section 86. The hot duct is created by the inner wall of an elongated torus 88 positioned in a cylindrical chamber 90 and spaced from the wall 92 of the chamber to define an annular return passage 94 for the hot fluids. The outer end of the torus 88 is spaced from the end wall 94 of the chamber to connect the duct 82 and the passage 94 at this point. At the inner end of the torus the passage 94 discharges into the vortex section 86 past pre-swirl vanes 96. The cold duct 84 is created by another elongated torus 98, coaxial with the torus 88 and having a smaller inside diameter so that the cold duch is smaller in diameter than the hot duct. This torus 98 is spaced from the chamber wall to define a cold return duct 100, and pre-swirl vanes, at the vortex section end of the duct 100 impart a swirl to the returning cold fluid.

Figure 4:
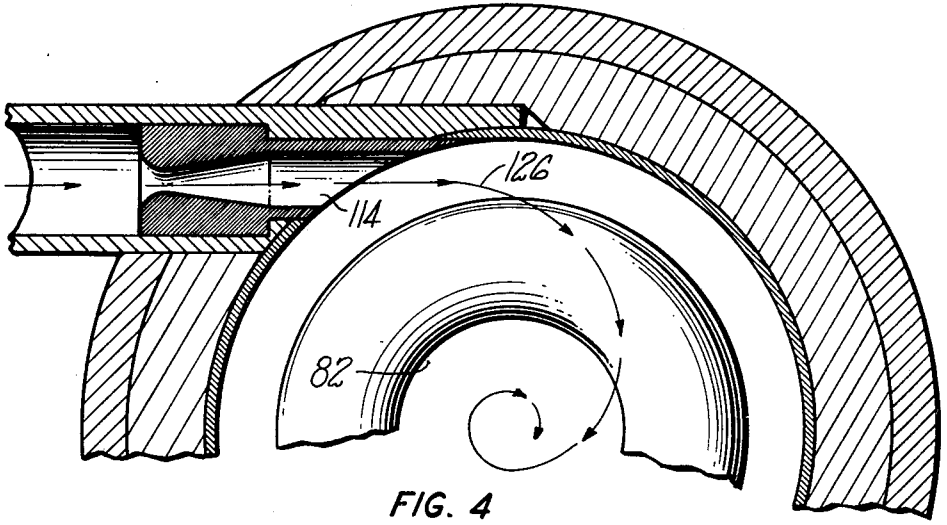
FIG. 4 is a transverse sectional view along line 4—4 of FIG. 3.

At the outer end of the torus 98 is positioned a rotor 102 defining a return passage 104, and this rotor may have turbine blades 106 thereon by which the rotor may be driven. The rotor is on a shaft 108 journalled in spaced bearings 110 and this shaft carries a compressor 112 for pressurizing fluid being discharged into the nozzle 114 in the vortex section 86. This fluid may be a portion of the hot fluid delivered to the compressor through a duct 116 from a centrally located port 118 at the outer end of the hot duct. A valve 120 may control the quantity of fluid reaching the compressor. Pressurized fluid from the compressor discharge 122 is delivered through a duct 124 to the nozzle.

Where the operating fluid is a gas, the nozzle 114, as shown in FIG. 4 is a convergent divergent, supersonic nozzle, as for example the conventional deLaval nozzle, and is positioned so that the discharge is tangential to the outer portion of the vortex chamber 86 which extends from the chamber wall inwardly between the inner ends of the toruses 88 and 98 and communicates with the inner ends of the hot and cold ducts. Because of the character of the separation process the inner end of the torus 98 may have an annular projection 128 at the inner diameter that initially directs fluid in the chamber 86 toward the hot duct as shown by the arrows. Separation occurs in this area and the cold stream moves into the cold duct, the hot stream continuing into the hot duct.

Depending upon power requirements, the turbine rotor may develop enough power to operate the compressor. Should more power be needed a motor 130 may be connected to the shaft 108 for supplementing the turbine. Also if desired, a part of the cold fluid from the cold duct may be discharged through the hollow shaft 108 into a duct 132 and thence to a place for use.

Heat energy is added to the system by heat exchanger 134 and removed by heat exchanger 136 on the outer surface of the wall 92 surrounding the cold and hot portions, respectively. Heat exchanger 134 cools a fluid flowing therethrough for use in refrigeration or for other cooling purposes. Heat exchanger heat a fluid flowing therethrough, this fluid then being used for any desired heating purpose. The arrangement may be further improved by circulating a fluid through the hollow torus 88 in heat exchange relationship with the hot fluid in the hot duct.

The turbine rotor may be used as an impeller driven from an external source either in starting the device or in increasing the velocity and whirl of the fluid. Under certain conditions this may replace the nozzle with the energy normally supplied by the nozzle being derived from the impeller. Obviously the generator, not shown, normally driven by the turbine rotor, would become a motor for driving the rotor as an impeller.

Figure 5:
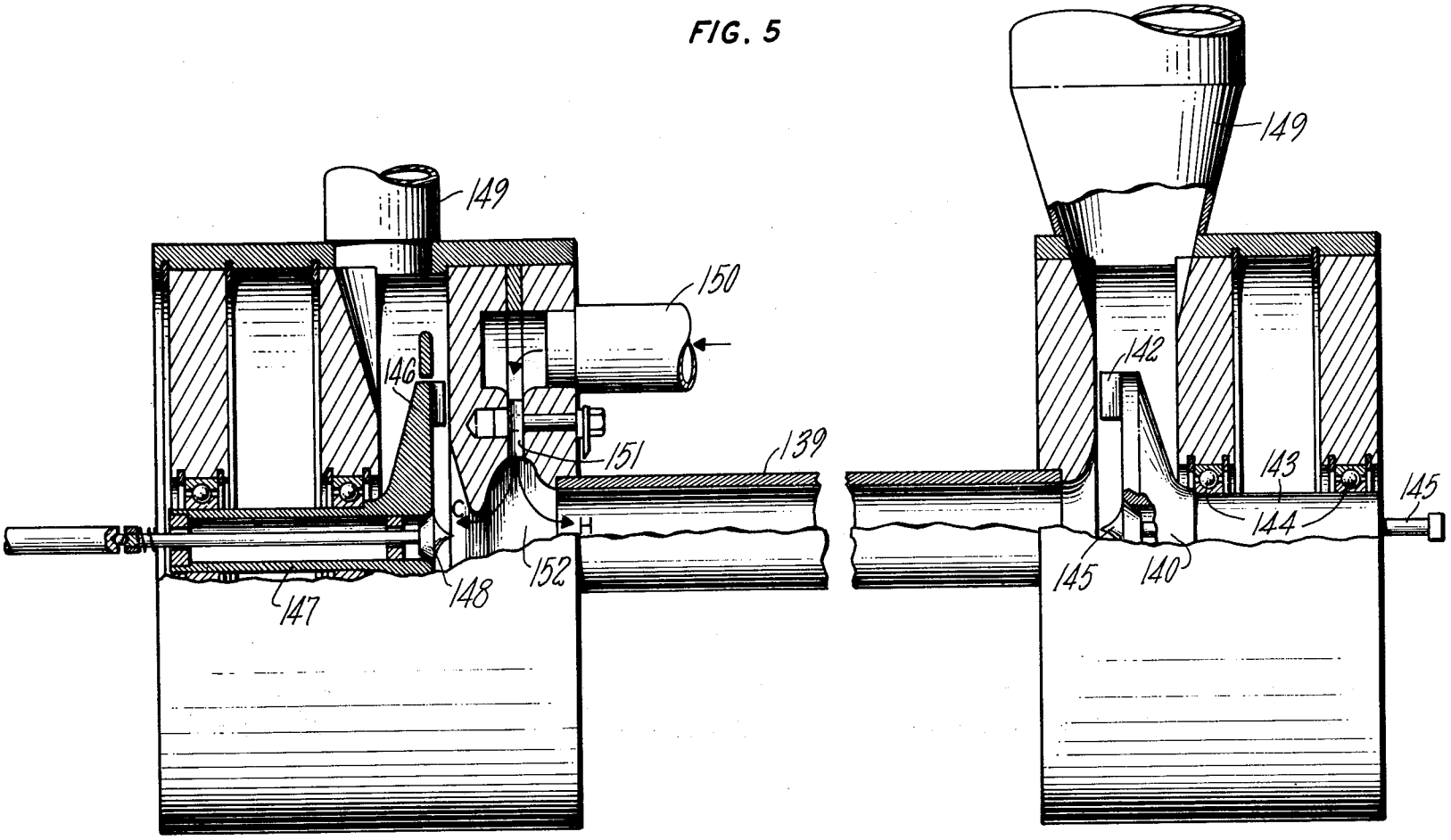
FIG. 5 is a partial longitudinal sectional view similar to FIG. 3 of a modification.

A further arrangement for energy removal is shown in FIG. 5. In this showing the outer end of the hot tube 139 may have a turbine disk 140 with blades 142. This turbine is driven by the hot fluid and is mounted on a shaft 143 journalled in bearings 144 provided at the end of the device. The turbine serves to remove heat energy from the hot fluid and to convert this into mechanical energy. A bleed valve 145 may be incorporated in the shaft as shown. Movement of valve 145 to the left permits the escape of some of the hot fluid for heating or other needs. The shaft may deliver power for any power requirement.

Similarly the cold end of the device may have a recovery turbine 146 for extracting heat energy from the cold fluid thereby further lowering the temperature of this fluid, and converting the extracted energy into mechanical energy delivered by the shaft 147. A bleed valve 148 axially of the turbine 146 permits a removal of some of the cold fluid for external use. The valves 145 and 148 may also serve to make the device self-sustaining by suitable control of the energy removal from the system. In this figure the hot and cold fluids are returned through the conduits 149 to the vortex not shown.

In this arrangement, the energy input is through an inlet duct 150 to a nozzle 151 discharging into the vortex or fluid separation chamber 152 communicating with the hot tube 139 and a cold outlet defined by the inwardly extending flange 153. The cold outlet is smaller in diameter than the hot tube, as shown.

Figure 6:
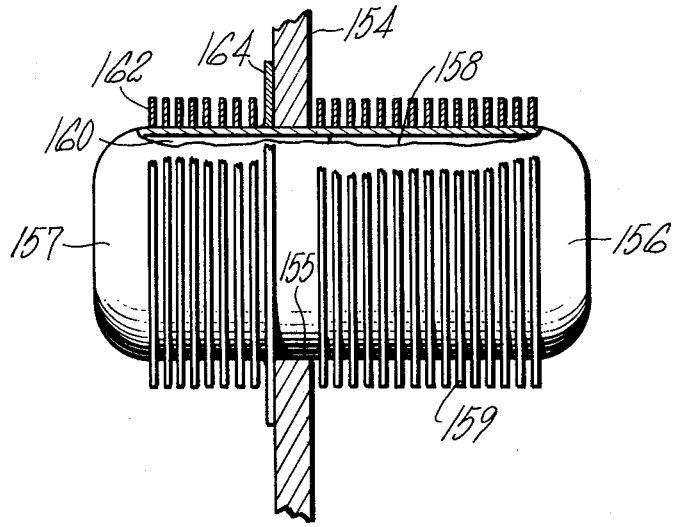
FIG. 6 is a view showing one of the devices in use.

One use for a device of this character may in air conditioning or heating of a building such as a home, office building or the like. As shown in FIG. 6, an outer wall 154 of a building has an opening 155 therein to receive a device such as that shown in FIG. 1. For heating, the device has its hot end 156 within the building and the cold end 157 outside the building. As the device operates, the hot end of the device gives up heat by a circulation of air over the heat exchanger 158 surrounded by the radiating fins 159 and the cold end absorbs heat from the outside air through the heat exchanger 160 by a flow of outside air over the surrounding fins 162. Thus the device functions much as a heat pump but with a much simpler construction. This simpler construction is particularly advantageous when made in large and very large units.

For air conditioning the position is reversed with the cold end inside the room and the hot end outside the building. In this position the device gives up heat to the outside air and removes heat from the air within the building for cooling or air-conditioning the air. A suitable flange 164 permits mounting the device in either position on the wall 150.

Figure 7:
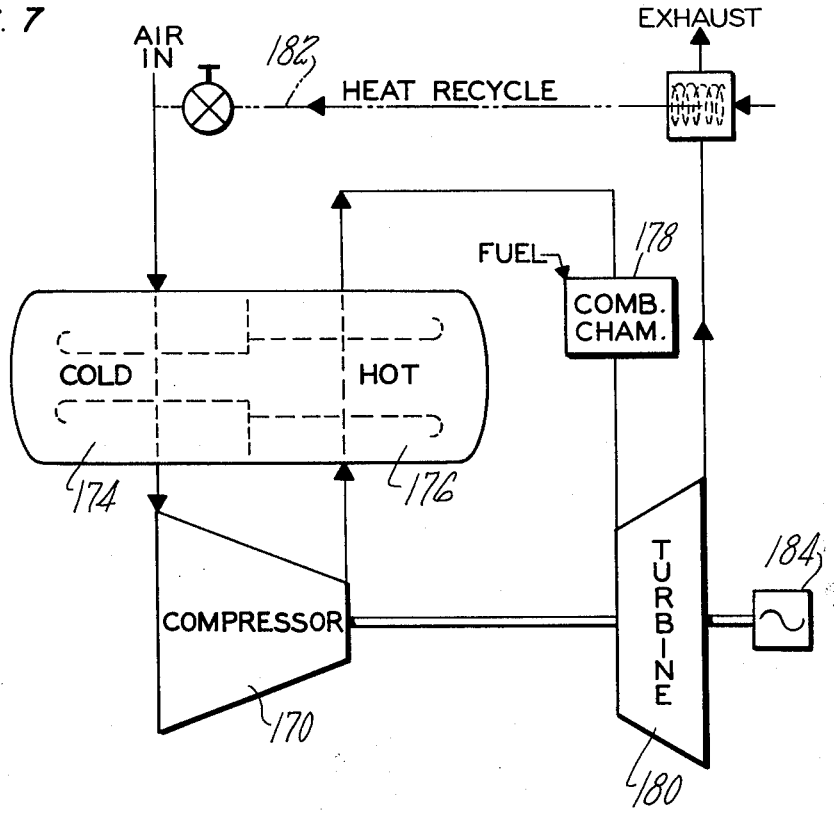
FIG. 7 is another view showing another use of the device.

Another use may be in gas turbine systems. As shown in FIG. 7, the air entering the compressor 170 is directed over the cold end 172 of the device 174 for lowering the air temperature and improving the compression cycle. Air discharging from the compressor is circulated over the hot end 176 before reaching the combustion chamber 178 on its way to the turbine 180.

Heat removed from the inlet air to the compressor by the cold end of the device is added to the combustion air by the hot end thus the compressor inlet air temperature is lowered, to improve compressor efficiency and capacity, and the combustion chamber inlet temperature is correspondingly raised, thereby increasing the turbine inlet temperature with a given quantity of fuel or permitting a reduction in fuel quantity for the same turbine inlet temperature.

Heat from the turbine exhaust may be returned in part to the compressor inlet by the return duct 182. If the energy exchange device supplies enough heat to the air entering the turbine the combustion chamber may be omitted and the turbine system may be a closed cycle system with all the turbine exhaust gas returned to the compressor inlet. The turbine drives an energy utilizer represented by a generator 184.

Figure 8:
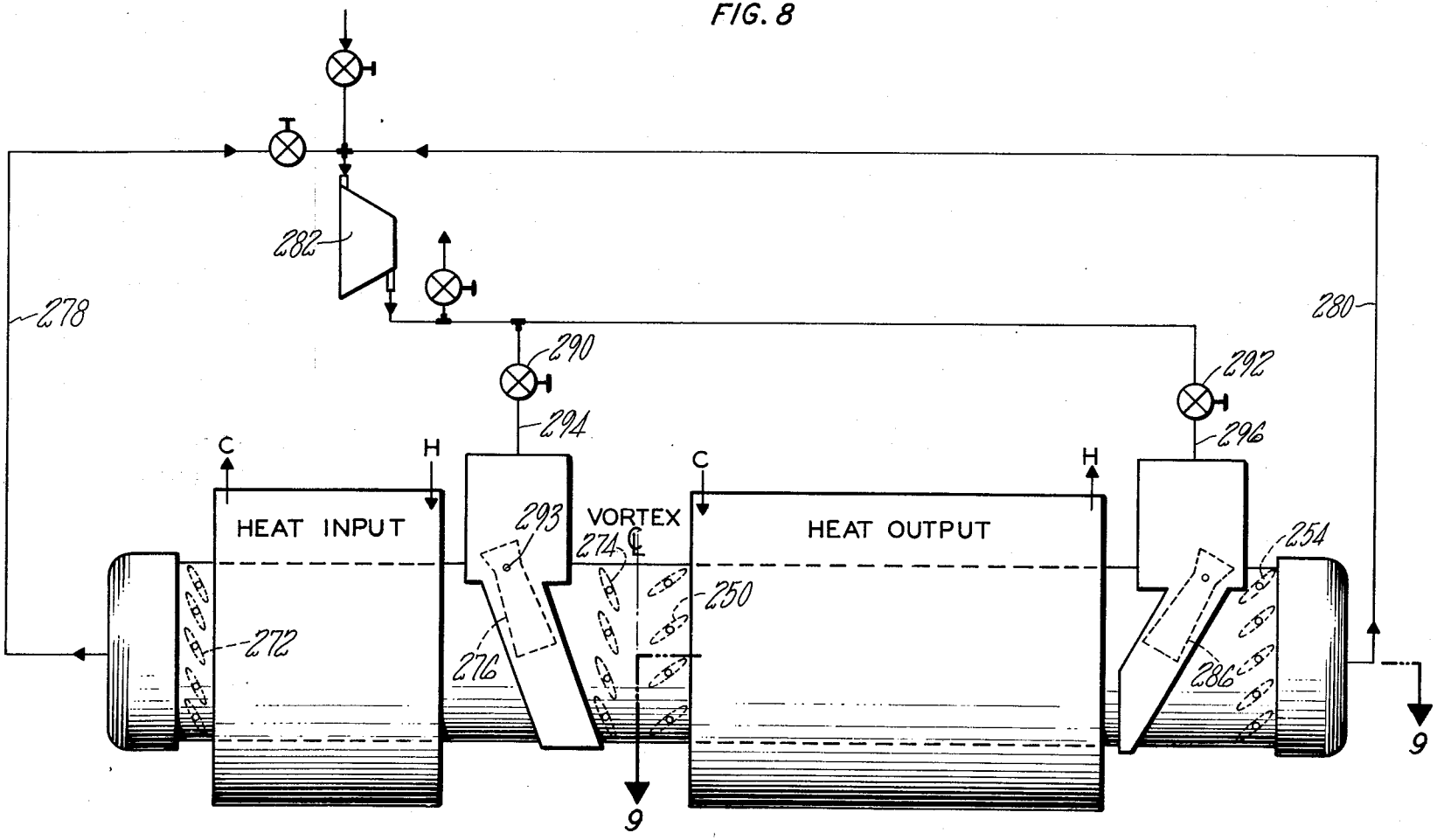
FIG. 8 is a plan view of a modification.

As shown in FIGS. 8 and 9 the return flow may be controlled by one or more rows of guide vanes. This arrangement is similar to that above described in FIG. 1 with a row of vanes 230 at the inner end of the return duct 252, FIG. 9, and another row of vanes 254 at the outer end of the return duct. These vanes may also serve to support the inner body 256 that defines the inner wall of the return duct. Each vane 254 is mounted to turn on a pin 258, FIG. 10 that extends inwardly from the outer case 260 and is secured as by threads 262 in the inner body. The outer end of the pin has a flange 264 overlying the outer end of the pivot tube 266 carrying the vane. The end of the tube 266 has a ring 268 between the flange 264 and a boss 270 in the outer case. This ring permits turning of the vane and locking it in the desired position. The vanes 250 may be similarly mounted.

Other vanes 272 and 274 may be located at outer and inner ends of the cold return duct and being similarly mounted may be adjustable to control the cold return flow. The vane structure may also serve to support the inner body at this end of the device.

It will be understood that each set of vanes may be individually adjusted thereby controlling the relative flows in the hot and cold returns and will permit adjustment of the flows to produce maximum performance of the unit.

In this arrangement, the initial fluid to establish the vortex is supplied tangentially of the return duct through a nozzle 276 having a small angle from a normal to the axis to impart to the entering fluid a small longitudinal orientation so that the vortex will move toward and enter the radial entry passage to the vortex tube.

As shown in these figures, a portion of the operating fluid may be withdrawn from either end of the device as by conduits 278 and 280 from the cold and hot ends respectively. This portion of the operating fluid passes through a compressor 282 and is then reintroduced into the system through tangential nozzles 276 and 286 of the type above described. Nozzle 276 is located in the cold return stream adjacent to the inlet passage 288, FIG. 9, and nozzle 286 is located adjacent the outer end of the hot return stream. Both nozzles are skewed to impart an axial flow to the vortex produced as indicated. Suitable valves 290 and 292 in the conduits 294 and 296 from the compressor to the nozzle permit a further control of the system. Other valving as described above controls the amount of fluid removed from the system into the conduits 278 and 280. The nozzles 276 and/or 286 may be adjustable to control the amount of axial component to the fluid discharged from them. Thus as shown in FIG. 8 the nozzle is mounted to pivot on a radial pivot pin 293 with suitable stops not shown by which the angle may be adjusted.

Figure 12:
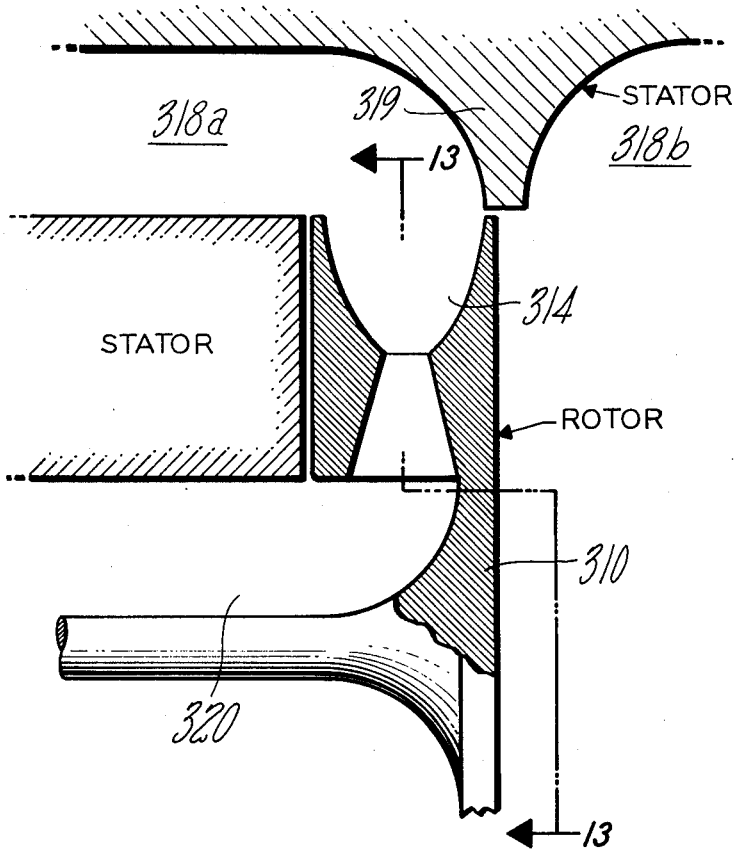
FIG. 12 is a fragmentary section through the nozzles of FIG. 11.
Figure 13:
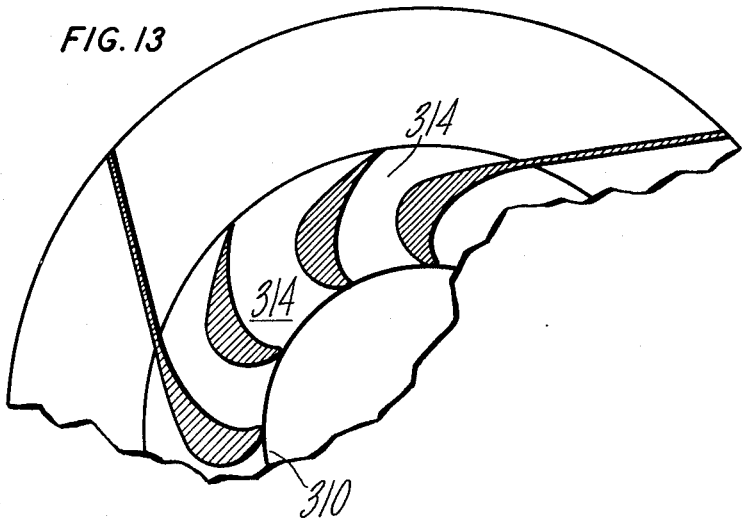
FIG. 13 is a view at right angles to the section of FIG. 12.

The apparatus above described is based upon the Ranque-Hilsch tube concept of dividing a vortex flow into cold and hot discharges. It is equally adapted to other forms of energy separators. As shown in FIGS. 11 to 13, the device includes aligned rotors 300 and 302 journalled in bearings 304 and 306 in the housing 308 and each carrying, on their inner ends, disks 310 and 312 each having a row of nozzles 314 and 316 therein. These nozzles, as shown in FIGS. 12 and 13 are supersonic convergent-divergent nozzles and discharge tangentially to impart a rotary motion to the discharging fluid and a reverse rotary thrust to the rotors. The nozzles may be of the type shown in Sohre U.S Pat. No. 3,804,335. The nozzles discharge into an outer flow separation chamber 318 and the flow in this chamber is divided by the operation of the device into a cold flow, moving to the left, in passage 318*a* and a hot flow moving to the right, in passage 318*b*. Surrounding the nozzles is an axially movable guide 319 in the chamber that controls the distribution of the hot and cold fluids and thus controls the maximum temperatures in the cold and hot passages.

The return flow of the hot and cold fluids is in the return passages 320 and 322 defined around the rotor shafts by inner bodies 324 and 326, these bodies also defining along their outer surfaces the hot and cold passages 318*a* and 318*b*. The inlets to the nozzles 314 and 316 are at the inner ends of the return passages. The return flow is guided by end closures 328 and 330 axially slidable within the outer casing 308 and spaced from the end caps 332 and 334 that support the bearings for the rotors. These closures allow clearance around the rotor shafts to permit the introduction of operating fluid under pressure supplied by a compressor 336. Operating fluid for supplying the compressor may be withdrawn from the outer ends of the hot and cold ducts as shown. Suitable valving 338 and 339 in the conduits 340 and 341 to and from the compressor permit a control of the operation of the device either alone or in conjunction with the movable end closures and the movable guide 319. Other valves 342 and 343 in conduits 344 and 345 control the quantity of fluid from the cold and hot ducts to be returned to the compressor.

The cold rotor 310 is driven by the thrust from the nozzles and the expansion of the fluid through the nozzles reduces the temperature of the fluid entering the duct 318*a*. This rotor may drive a generator 346. The hot rotor 312 is driven in a direction opposite to the thrust imparted by the nozzles 316 and thus heat the fluid discharging from these nozzles such that hot fluid is discharged into passage 318*b*. A motor 348 drives the rotor 312 and may receive its power from the generator 346 through interconnecting leads 349 and a control switch 350. Alternatively leads 351 may supply electrical power from an external source.

In addition to the production of electrical energy the device may be used for heating and/or cooling. The casing 308 has two heat exchangers 352 and 353 mounted thereon or fitted therein. The heat exchanger 353 surrounds the cold fluid duct and serves to supply an auxiliary cooling fluid for use in any cooling function such as air conditioning or refrigeration. The effect of this heat exchanger is to heat the fluid in the cold duct so that it is nearly restored to the original nozzle inlet temperature. The heat exchanger 353 surrounds the hot fluid duct and serves to heat an auxiliary heating fluid for use where heat may be needed as in space heaters or other heating purposes. This exchanger removes enough heat from the hot fluid so that the fluid in the hot return passage is nearly at the original nozzle inlet temperature.

The device may be built not only in small sizes but its use in large scale units is feasible because of the simplicity of the process. Furthermore, temperature differences of several thousand degrees are possible within the limits of the material of the device depending upon the fluids used and the operating pressures. Such devices could be utilized in tandem for producing extremely hot or cold temperatures.

Although many different fluids may be utilized, two or three phase fluids have interest. For example wet steam could be used with the device serving as a condenser (cold side) and reheated (hot side) with snow being discharged at the cold end as a snow maker. Other uses of multiphase fluids will be apparent.

Devices of this type can be utilized to avoid thermal pollution of rivers and other bodies of water by power plants either conventional or nuclear, since the cooling of the power plant operating fluid or fluids can be readily accomplished without the need for using water from rivers or lakes. The heat reclaimed by the device could then produce additional power.

Although the invention has been shown and described with respect to preferred embodiments thereof, it should be understood by those skilled in the art that the various changes and omissions in the form and detail thereof may be made therein without departing from the spirit and the scope of the invention.

Having thus described typical embodiments of my invention, that which I claim as new and desire to secure by Letters Patent of the United States is:

1. An energy system including:

a casing having a vortex chamber therein;

at least one nozzle introducing fluid tangentially into the chamber to form a helical flow therein, such flow serving to divide the fluid into hot and cold streams each having a kinetic energy swirl;

hot and cold conduits communicating at one end with the chamber and positioned to receive the swirling hot and cold streams respectively and maintain the kinetic energy therein;

at least one of said conduits having its other end also connected to the chamber downstream of the nozzle for the return of the fluid stream to said chamber in such a manner as to retain much of the kinetic energy therein of the stream; and energy exchange means associated with said one of said conduits for changing the energy level of the fluid therein before it is returned to the chamber.

2. An energy system as in claim 1 in which both conduits have their other ends connected to the chamber and in which an energy exchange device is associated with each conduit for removal of energy from the hot stream and addition of energy to the cold stream.

3. An energy system as in claim 2 in which one of the energy exchange means includes a turbine.

4. An energy system as in claim 1 in which means are provided for bleeding a part of one of the fluid streams from its conduit.

5. An energy system as in claim 1 in which the flow in the conduits is helical and flow control vanes are positioned in at least one of the conduits to control the flow.

6. An energy system as in claim 2 in which the energy exchange means include heat exchangers.

7. A vortex tube system including:

a casing having a fluid separation chamber in which a fluid introduced in a vortex is separated into hot and cold swirling streams;

means for introducing the fluid into the chamber to produce a helical flow therein for causing the fluid separation;

hot and cold conduits connected to said chamber to receive the hot and cold swirling streams of fluid, one of said conduits including a return duct for the return of the fluid therein to the chamber downstream of said means, said return duct being connected to minimize kinetic energy loss from the swirling fluid; and energy exchange means associated with said conduits for the removal of energy from the hot stream and addition of energy to the cold stream.

8. A system as in claim 7 in which both conduits include return ducts for a return of the fluids therein to the chamber to join the helical flow therein, said ducts being arranged to maintain a significant kinetic energy swirl in the fluids as they reenter the helical flow.

9. A system as in claim 8 in which one of the energy exchange means includes a turbine for the removal of energy from the stream.

10. A system as in claim 8 including means for bleeding a part of one of the fluid streams therefrom.

11. A system as in claim 8 in which at least one of the energy exchange means includes a heat exchanger by which to change the energy level of a secondary fluid in the exchange by exchange of energy between the secondary fluid and the operating fluid in the system.

12. A system as in claim 7 in which the flow in the conduits is helical and variable position vanes in at least one conduit provides control of the helical flow.

13. A system as in claim 8 in which energy exchange means associated with the conduits remove heat energy from the hot stream and add heat energy to the cold stream so that the returning streams entering the chamber are nearly at the same temperature.

14. A system as in claim 8 including a compressor for pressurizing the fluid and a supersonic nozzle through which the pressurized fluid is introduced into the chamber.

15. An energy exchange system including:

a casing having a fluid separation chamber therein;

annular inner bodies in the casing at opposite sides of and defining the chamber, each inner body being spaced from the walls of the chamber to define an annular passage surrounding the body and communicating with the chamber, each annular passage communicating at its end remote from the chamber with the axial passage within the associated inner body, said axial passages in the inner bodies also communicating with the chamber, thereby establishing a continuous duct through the annular passage and the axial passage for a return flow of fluid from the chamber;

nozzle means for delivering a helical flow of operating fluid into said chamber for a separation of the fluid into hot and cold streams with one stream flowing around each inner body; and energy exchange means associated with each inner body for changing the energy level in the streams flowing around the inner bodies.

16. An energy exchange system as in claim 15 in which one of the energy exchange means includes a turbine.

17. An energy exchange system as in claim 15 in which at least one of the energy exchange means is a heat exchanger surrounding the associated inner body.

18. An energy exchange system as in claim 16 including a compressor for pressurizing the operating fluid delivered to the nozzle means, the compressor being driven by the turbine.

19. An energy exchange system as in claim 15 including flow control vanes positioned in at least one of the annular passages.

20. An energy exchange system as in claim 19 in which the flow control vanes are adjustable for control of the helical flow in said passage.

21. An energy exchange system as in claim 18 including vane supporting means which also support the inner body within the casing.

22. An energy exchange system as in claim 15 in which the nozzle means are positioned for discharge of the operating fluid into one of the annular passages for entry into the chamber.

23. An energy exchange system as in claim 15 in which the nozzles are positioned to establish the fluid separation to cause the hot and cold streams to enter the axial passages in the inner bodies with the return flow being in the annular passage.

24. An energy exchange system as in claim 15 in which the nozzle means are mounted on at least one rotor in the chamber, and including a shaft extending through one of said axial passages for supporting the rotor, and a generator on the shaft to receive power developed by the nozzles on the rotor.

25. An energy system including:

a casing having a fluid separation chamber therein;

means for imparting a helical flow to fluid entering the chamber with the flow divided thereby into hot and cold swirling streams;

hot and cold conduits communicating at one end with the chamber in such a manner as to receive the hot and cold swirling streams respectively with the kinetic energy therein;

return conduits from the other ends of said conduits to said chamber to enter the helical flow therein;

energy exchange means connected to at least one of said hot and cold conduits for changing the energy level in the associated stream before it is returned to said first means.

26. An energy system as in claim 25 in which the flow imparting means is an impeller.

27. An energy system as in claim 25 in which the flow imparting means includes an impeller in one of the conduits.

* * * * *